US007730881B1

(12) United States Patent
Pedicini et al.

(10) Patent No.: US 7,730,881 B1
(45) Date of Patent: Jun. 8, 2010

(54) PORTABLE ELECTRIC MOTOR DRIVEN COMPRESSED AIR PROJECTILE LAUNCHER

(75) Inventors: Christopher S. Pedicini, Neshville, TN (US); John D. Witzigreuter, Canton, GA (US)

(73) Assignee: Impulse Solutions LLC, Flagstaff, AZ (US)

( * ) Notice: Subject to any disclaimer, the term of this patent is extended or adjusted under 35 U.S.C. 154(b) by 866 days.

(21) Appl. No.: 11/549,510

(22) Filed: Oct. 13, 2006

Related U.S. Application Data

(63) Continuation-in-part of application No. 11/052,542, filed on Feb. 7, 2005.

(60) Provisional application No. 60/772,367, filed on Feb. 10, 2006.

(51) Int. Cl.
*F41B 11/12* (2006.01)
*F41B 11/32* (2006.01)

(52) U.S. Cl. ..... 124/65

(58) Field of Classification Search ..... 124/63–68, 124/70, 72, 77
See application file for complete search history.

(56) References Cited

U.S. PATENT DOCUMENTS 3,561,319 A * 2/1971 Joyce et al. ..... 89/7
3,951,038 A * 4/1976 Van Langenhoven ..... 89/7
5,261,384 A * 11/1993 Hu ..... 124/66
5,282,454 A * 2/1994 Bell et al. ..... 124/49
5,531,210 A * 7/1996 Meiser et al. ..... 124/66
5,791,325 A * 8/1998 Anderson ..... 124/56
5,794,606 A * 8/1998 Deak ..... 124/51.1
5,816,232 A * 10/1998 Bell ..... 124/51.1
6,305,367 B1 * 10/2001 Kotsiopoulos et al. ..... 124/49
6,564,788 B1 * 5/2003 Hu ..... 124/66
6,857,422 B2 * 2/2005 Pedicini et al. ..... 124/63
7,077,117 B1 * 7/2006 Chu ..... 124/32
7,100,592 B1 * 9/2006 Yang ..... 124/67
7,191,775 B1 * 3/2007 Lo ..... 124/65
2003/0098019 A1 * 5/2003 Hu ..... 124/66
2005/0000505 A1 * 1/2005 Pedicini et al. ..... 124/63
2005/0183709 A1 * 8/2005 Marsac ..... 124/63
2005/0188974 A1 * 9/2005 Pedicini et al. ..... 124/65
2006/0231083 A1 * 10/2006 Tsurumoto ..... 124/66

(Continued)

FOREIGN PATENT DOCUMENTS

JP 06257993 A * 9/1994

(Continued)

*Primary Examiner*—Troy Chambers
(74) *Attorney, Agent, or Firm*—Jay Schloff

(57) ABSTRACT

A portable motor driven air gun powered by a power source includes a motor that is coupled to a linear motion converter which drives a piston. The piston compresses air in a chamber against a forward air compression valve producing high-pressure air. When sufficient energy is stored within the air stream by the piston, the compression valve opens which releases the compressed air to push a projectile through a barrel. The engagement and disengagement of the linear motion converter and the connected piston to the motor can be controlled using sensors. The linear motion converter further is coupled to a bolt thru a lost motion device to facilitate positioning of the projectile for firing. The direction speed and operative modes of the gun may be controlled with an electric circuit. The power source is preferably rechargeable, allowing the air gun to be operated independent from either a wall outlet or a compressed air supply.

30 Claims, 16 Drawing Sheets

U.S. PATENT DOCUMENTS

| | | | | |
|---|---|---|---|---|
| 2006/0243263 | A1* | 11/2006 | Tsurumoto | 124/66 |
| 2007/0000483 | A1* | 1/2007 | Tsurumoto | 124/73 |
| 2007/0261689 | A1* | 11/2007 | Tai et al. | 124/67 |
| 2007/0289586 | A1* | 12/2007 | Tsurumoto | 124/73 |

FOREIGN PATENT DOCUMENTS

| | | | |
|---|---|---|---|
| JP | 2002168594 | A * | 6/2002 |

* cited by examiner

PORTABLE ELECTRIC MOTOR DRIVEN COMPRESSED AIR PROJECTILE LAUNCHER

PRIORITY

The present invention claims priority under 35 USC section 119 based on provisional application 60/772,367 on Feb. 10, 2006.

CROSS REFERENCE TO RELATED APPLICATIONS

This utility application is the Continuation-In-Part application of the nonprovisional utility U.S. patent application Ser. No. 11/052,542 filed Feb. 7, 2005 which claims benefit of patent application Ser. No. 10/764,793 filed on Jan. 26, 2004, (now U.S. Pat. No. 6,857,422) which claims benefit from the U.S. Provisional Application Nos. 60/477,591 filed on Jun. 12, 2003 and 60/517,069 filed on Nov. 5, 2003, and 60/772,367 filed Feb. 10, 2006 each of which are herein incorporated by reference in their entirety.

BACKGROUND OF INVENTION

This invention relates to an improvement to pneumatic guns, air rifles, pellet rifles, paintball guns and the like. Such pneumatic guns are typically driven by either hand or electrically cocked springs, compressed gas, or hand operated pumps and suffer from a number of disadvantages outlined in more detail below.

Air rifles have been around for many years and have seen numerous evolutionary changes over the years. The most common methods for propelling the projectile use the energy from compressed gas or from a spring. There are four major techniques shown in the prior art for launching the projectile with many variations based upon such teachings. These techniques include: (i) the use of stored compressed gas in the form of carbon dioxide cylinders or other high pressure storage tanks; (ii) using a powerful spring to push a piston which compresses air which then pushes the projectile; (iii) using a hand pump to pressurize the air for subsequent release; and (iv) using a direct acting means such as a solenoid plunger or centrifugal force to push the projectile out of the barrel. All of these methods have distinct disadvantages when compared to the present invention.

The first technique requires a source of compressed air, such as a tank or canister. Filling, transporting and using such a canister represents an inconvenience and potential safety hazard for the user. Often, additional equipment such as regulators, evaporation chambers, and other controls are required to reduce the pressure in the cylinder to a level suitable for launching the projectile. This peripheral equipment increases the cost and complexity of such an air gun. Additionally, for carbon dioxide driven air or paintball guns, the velocity of the projectile can vary significantly depending on the canister temperature. Furthermore, these tanks store a large amount of energy which, can be suddenly released through a tank fault, creating a potential safety issue. Additional teachings such as those contained in U.S. Pat. Nos. 6,516,791, 6,474,326, 5,727,538 and 6,532,949 teach of various ways of porting and controlling high pressure air supplies to improve the reliability of air guns (specifically paintball guns and the like) by differentiating between the air stream which is delivered to the bolt which facilitates chambering the projectile and the air stream which pushes the projectile out of the barrel. All of these patents still suffer from the major inconvenience and potential safety hazard of storing a large volume of highly compressed gas within the air gun. Additionally, as they combine electronic control with the propulsion method of stored compressed gas, the inherent complexity of the mechanism increases, thus, increasing cost and reliability issues. An additional teaching in this area in U.S. Pat. No. 6,142,137 shows an electrical means to assist in the trigger control of a compressed air gun. In this patent, an electromotive device is used in conjunction with electronics to define various modes of fire control such as single shot, burst or automatic modes. This addresses the ability of multiple modes of fire, but does not solve the fundamental propulsion issues of safety and inconvenience associated with gas cylinders.

A second technique which has been used for quite a few years in many different types of pellet, "bb" or air rifles has a basic principle of storing energy in a spring which is subsequently released to rapidly compress air. The highly compressed air created by a spring acting on a piston pushes the projectile out of the barrel at high velocity. Problems with this method include the need to "cock" the spring between shots thus limiting its use to single shot devices and low rates of fire. Furthermore, the unwinding of the spring results in a double recoil effect. The first recoil is from the initial forward movement of the spring, but a second recoil occurs when the spring slams the piston into the end of the cylinder (i.e. forward recoil). Additionally, spring air rifles require a significant amount of maintenance and, if dry-fired, the mechanism is easily damaged. Finally, the effort required for such "cocking" is often substantial and can be difficult for many individuals. References to these style air guns can be found in U.S. Pat. Nos. 3,128,753, 3,212,490, 3,523,538, and 1,830,763. Additional variations on the above technique have been attempted through the years including using an electric motor to cock the spring that drives a piston. This variation is detailed in U.S. Pat. Nos. 4,899,717 and 5,129,383. While this innovation solves the problem of cocking effort, the resulting air rifle still suffers from a complicated mechanism, double recoil and maintenance issues associated with the spring piston system. Another mechanism which uses a motor to wind a spring is shown in U.S. Pat. Nos. 5,261,384 and 6,564,788. Herein, a motor is used to compress a spring which is connected to a piston. The spring is subsequently quickly released allowing it to drive a piston compressing air which pushes a projectile out the barrel. This implementation still suffers from similar limitations inherent in the spring piston systems. Hu teaches of using a motor to wind a spring in these patents. Because there is no compression valve, the spring must quickly compress the air against the projectile to force it out the barrel at good velocity. This requires a strong spring to rapidly compress the air when the mechanism releases. Springs in such systems are highly stressed mechanical elements that are prone to breakage and which increase the weight of the air gun. A further disadvantage of Hu's teaching is that the spring is released from the rack pinion under full load causing the tips of the gear teeth to undergo severe tip loading. This causes high stress and wear on the mechanism especially the gear teeth. This is the major complaint for those guns in the commercial market and is a major reliability issue with this style mechanism. A further disadvantage of this type of mechanism is that upon scale up to accept larger projectiles or projectile with more energy, there occurs much increased wear and a forward recoil which is the result of the piston impacting the front end of the cylinder. In a dry fire (no projectile), the mechanism can be damaged as the piston slams against the face of the cylinder. Hu teaches use of a breech shutoff, that is common in virtually all toy guns since the air must be directed down the barrel and the flow into the projectile inlet port must be minimized. Hu specifically does not incorporate an air compression valve in his patents which is a restrictive valve against which the piston compresses the air for subsequent release. Thus, forward recoil, high wear and low power are drawbacks in these types of mechanisms. A similar reference can be seen in U.S. Pat. No. 1,447,458 which shows a spring winding and then delivery to a piston to compress air and propel a projectile. In this case, the device is for non-portable operation.

The third technique, using a hand pump to pressurize the air, is often used on low end devices and suffers from the need to pump the air gun between 2 to 10 times to build up enough air supply for sufficient projectile velocity. This again limits the air rifle or paintball gun to slow rates of fire. Additionally, because of the delay between when the air is compressed and when the compressed air is released to the projectile, variations in the projectile velocity are quite common in these style air guns. Further taught in U.S. Pat. Nos. 2,568,432 and 2,834,332 is a method to use a solenoid to directly move a piston which compresses air and forces the projectile out of the air rifle. While this solves the obvious problem of manually pumping a chamber up in order to fire a gun, these devices suffer from the inability to store sufficient energy in the air stream. Solenoids are inefficient devices and can only convert very limited amounts of energy due to their operation. Furthermore, since the air stream is coupled directly to the projectile in this technique as it is in spring piston designs, the projectile begins to move as the air is being compressed. This limits the ability of the solenoid to store energy in the air stream to a very short time period and further relegates its use to low energy air rifles. In order to improve the design, the piston must actuate in an extremely fast time frame in order to prevent significant projectile movement during the compression stroke. This results in a very energetic piston mass similar to that shown in spring piston designs and further results in the undesirable double recoil effect as the piston mass must come to a halt. Additionally, this technique suffers from dry-fire in that the air is compressed between the piston and the projectile. A missing projectile allows the air to communicate to the atmosphere through the barrel and can damage the mechanism in a dry-fire scenario. Another variant of this approach is disclosed in U.S. Pat. No. 1,375,653, which uses an internal combustion engine instead of a solenoid to act against the piston. Although this solves the issue of sufficient power, it is no longer considered an air rifle as it becomes a combustion driven gun. Moreover, it suffers from the aforementioned disadvantages including complexity and difficulty in controlling the firing sequence. Further taught in U.S. Pat. Nos. 4,137,893 and 2,398,813 to Swisher is the use of an air compressor coupled to a storage tank which is then coupled to the air gun. Although this solves the issue of double recoil, it is not suitable to a portable system due to inefficiencies of compressing air and the large tank volume required. This type of system is quite similar to existing paintball guns in that the air is supplied via a tank and not compressed on demand. Using air in this fashion is inefficient and not suitable for portable operation since much of the air compression energy is lost to the environment thru the air tank via cooling. Forty percent or more (depending on the compression ratio) of the compressed air energy is stored as heat and is lost to do work when the air is allowed to cool. Furthermore, additional complexity and expense is required to regulate the air pressure from the tank so that the projectile velocity is repeatably controlled. A variation of the above is to use a direct air compressor as shown in U.S. Pat. No. 1,743,576. Again, due to the large volume of air between the compression means and the projectile, much of the heat of compression is lost leading to inefficient operation. Additionally, this patent teaches of a continuously operating device which suffers from a significant lock time (time between trigger pull and projectile leaving the barrel) as well as the inability to run in a semiautomatic or single shot mode. Further disadvantages of this device include the pulsating characteristics of the air stream which are caused by the release and reseating of the check valve during normal operation.

The fourth technique is to use direct mechanical action on the projectile itself. The teachings in U.S. Pat. Nos. 1,343,127 and 2,550,887 represent such mechanisms. Limitations of this approach include difficulty in achieving high projectile velocity since the transfer of energy must be done extremely rapidly between the impacting hammer and the projectile. Further limitations include the need to absorb a significant impact as the solenoid plunger must stop and return for the next projectile. This causes a double-recoil or forward recoil. Since the solenoid plunger represents a significant fraction of the moving mass (i.e. it often exceeds the projectile weight), this type of system is very inefficient and limited to low velocity, low energy air guns as may be found in toys and the like. Variations of this method include those disclosed in U.S. Pat. No. 4,694,815 in which a hammer driven by a spring contacts the projectile. The spring is "cocked" via an electric motor, but again, this does not overcome the prior mentioned limitations.

All of the currently available devices suffer from one or more of the following disadvantages:

1. Manual operation by cocking a spring or pumping up an air chamber.
2. Difficult to selectively perform single fire, semiautomatic, burst or automatic modes.
3. Inconvenience, safety and consistency issues associated with refilling, transport and use of high-pressure gas or carbon dioxide cylinders.
4. Non-portability and low efficiency. Carnival air rifles and the like are tethered to a compressed air supply powered by a compressor which loses a significant portion of the energy of compression to heat loss from the air tank thus making battery operation impractical.
5. Forward recoil effects, high wear, and dry fire damage associated with spring piston and electrically actuated spring piston designs.
6. Complicated mechanisms associated with electrically winding and releasing a spring piston design resulting in expensive mechanisms with reliability issues.
7. Inefficient use and/or coupling of the compressed air to the projectile resulting in low energy projectiles and large energy input requirements.

BRIEF SUMMARY OF THE INVENTION

In accordance with the present invention, a piston is driven by a rack and pinion mechanism to compress air within a cylinder against a mechanical compression valve. During the forward stroke of the piston, the bolt is moved forward enough to chamber the projectile and close off the projectile inlet port. At predetermined release position, the mechanical valve opens releasing high-pressure air thru the air passageways behind the projectile forcefully launching the projectile out the barrel. The piston and rack assembly then disconnects from the rack pinion and is reset to its initial position via a return spring. The return spring plays little or no part in the compression of the air for propelling the projectile and can be of small size. During the return of the piston to its initial position, a check valve replenishes the air to the air cylinder. An electric motor, which derives its power from a rechargeable battery pack, is coupled, to the rack thru a reduction mechanism and rack pinion. The rack and piston assembly is coupled to a bolt such that the bolt moves in cooperation with the movement of the piston. This coupling preferably includes springs and sliding members to reduce the travel of the bolt to a fractional percentage of the overall piston movement and to limit the force that the bolt can exert in shutting off the projectile inlet port. Shutting off the projectile feed port is a near separate and independent function and is not to be confused with the function performed by the compression valve.

Accordingly, besides the objects and advantages of the portable electric air gun as described, several objects and advantages of the present invention are:

1. To provide an electric motor driven gun with increased safety as the energy is stored electrically and available on demand and not stored in high pressure cylinders.
2. To provide an apparatus in which the operation is portable eliminating any tethering of hoses or cords.
3. To provide an electric motor driven air gun in which the piston is prevented from impacting the cylinder end thus eliminating double recoil.
4. To provide an apparatus in which the control of the projectile is enabled by electronic apparatus thus increasing the safety profile and speed control.
5. To provide an electric motor driven gun in which the source of energy is a rechargeable power supply eliminating the use of disposable or refillable gas pressure cylinders thus increasing convenience, safety and reducing operating cost.
6. To provide an electric motor driven gun which does not use a spring to compress the air thus decreasing mechanism size, mechanism wear, mechanism weight.
7. To provide an electric motor driven gun in which the chambering of the projectiles is controlled by the electric motor thereby simplifying the design and increasing efficiency.
8. To provide an electric motor driven gun which uses the heat of compression by reducing the delay between compression and firing, thus, increasing overall efficiency.
9. To provide an electric motor driven gun in which the energy to return the piston uses a spring which is energized on the compression stroke of the piston thus improving efficiency.
10 To provide an electric motor driven gun in which the gear and rack tips are not loaded by the full energy of compression thus significantly reducing gear tip wear.

To provide an electric motor driven gun in which the compressed air release is controlled mechanically thereby simplifying operation, reducing cost and improving reliability.

Further objects and advantages will become more apparent from a consideration of the ensuing detailed description and drawings.

BRIEF DESCRIPTION OF THE SEVERAL VIEWS OF THE DRAWINGS

Reference numbers for the drawings are shown below.

REFERENCE NUMBERS IN DRAWINGS

1 Motor
2 Power Source
3 Control Circuit
4 Rack
5 Piston
6 Bolt
7 Compression Valve
8 Barrel
9 Projectile
10 Start Switch
11 Magnet
12 Sensor
13 Compressed Air Passageway
14 Cylinder
15 Bolt Link
16 Projectile Inlet Port
17 Bumper
19 Bolt Rod
20 Bolt Return Spring
21 Forward Air Chamber
22 Projectile Feeder
23 Lost motion coupling
24 Valve Spool
25 Valve Body
26 Valve Retainer
27 Valve Return Spring
28 Valve Spool Stem
29 Cylinder end cap
30 Bolt Limit Spring
31 Drive Train
32 Piston Return Spring
33 Grip
34 Support Bearing
35 Rack Pinion
36 Crank Link
37 Check Valve
38 Check valve Ball
41 Linear Motion Converter
702 Main Body of Valve Spool
704 Reduced diameter Body of Valve Spool

DETAILED DESCRIPTION OF THE INVENTION

Although the following relates substantially to one embodiment of the design, it will be understood by those familiar with the art that changes to materials, part descriptions and geometries can be made without departing from the spirit of the invention. Additional designs can be created by combining various described elements. These may have particular advantages depending on the design requirements of the particular electric air gun.

Figure 1:
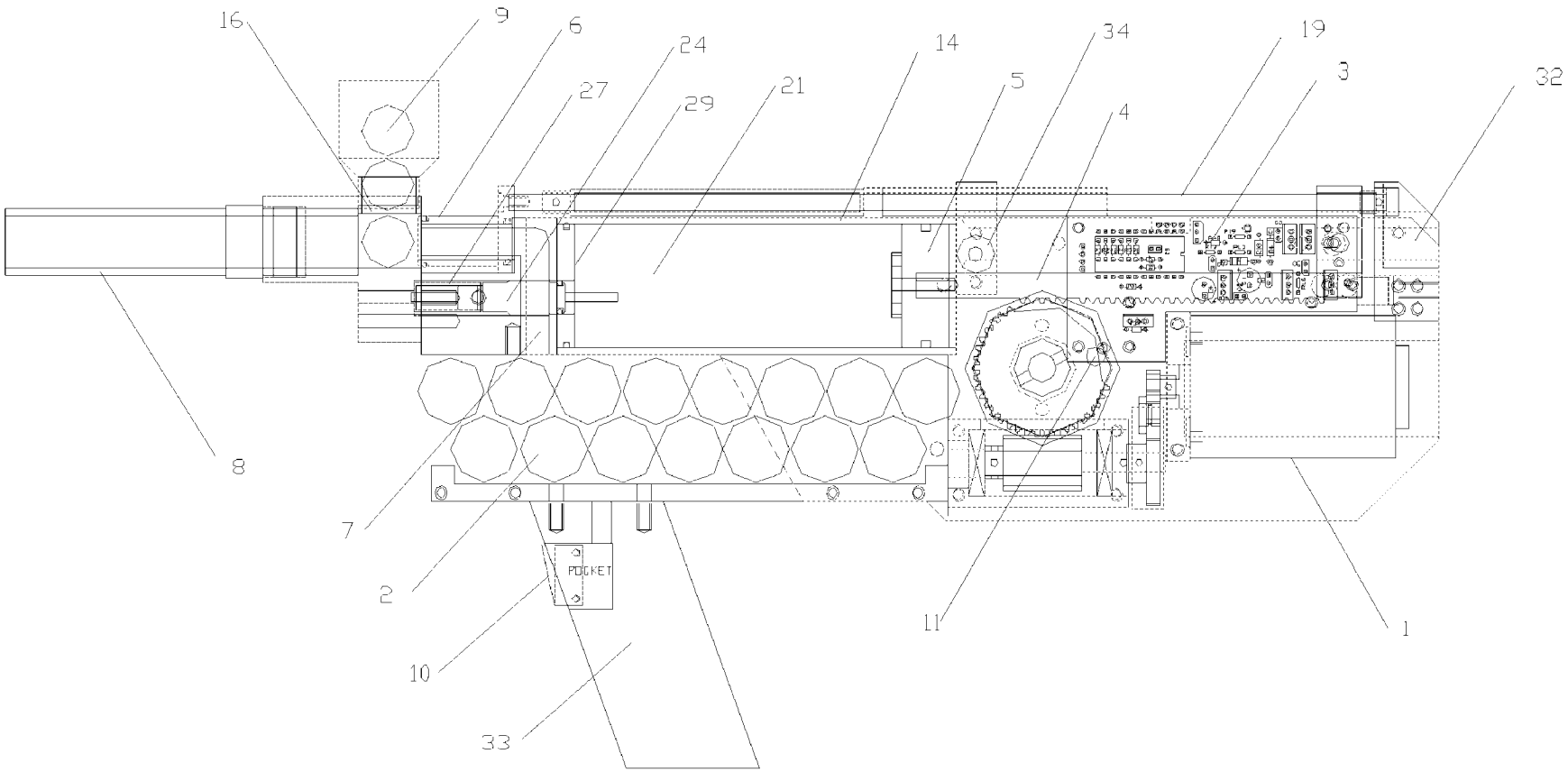
FIG. 1 is a side view of the electric powered projectile launcher.
Figure 2:
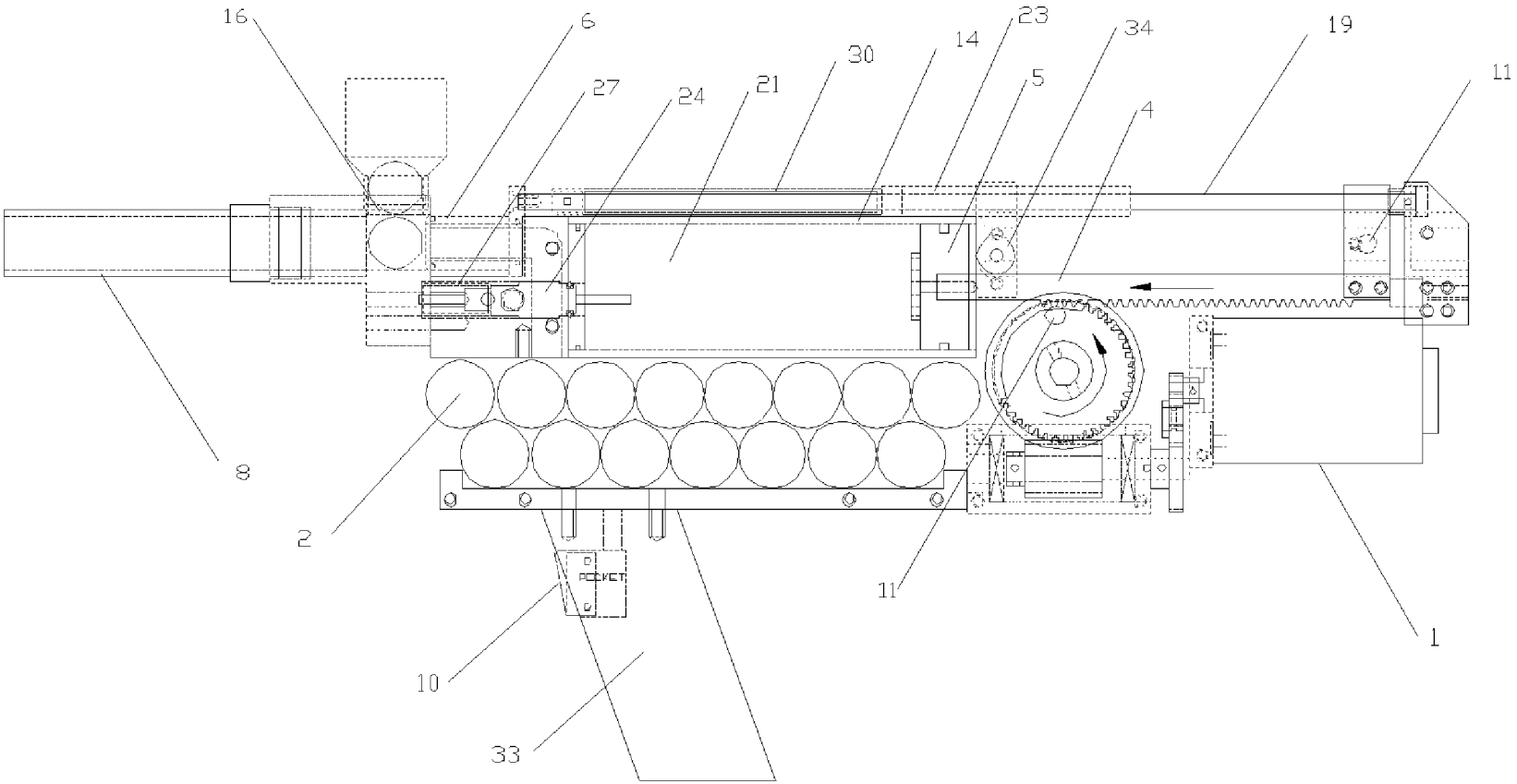
FIG. 2 is a side view showing the rack pinion ready to engage the rack.

In this embodiment, the front end of the piston (5), the cylinder (14) and the cylinder end cap (29) which in the preferred embodiment is a surface of the compression valve (7) define the volume of the forward air chamber (21) as shown in FIG. 1. At its initial state before the cycle starts, the forward air chamber (21) has a volume that is proportional to the size and weight of the projectile which includes the paintball. For paintball, we typically use a volume in the approximate range of 6 to 9 $in^3$ at standard temperature and pressure conditions. Although the initial pressure of this starting air can be varied, atmospheric pressure is normally chosen. The piston (5) moves linearly forward compressing the air in the forward air chamber (21) while also energizing the piston return spring (32). The piston return spring (32) biases the piston (5) to an initial position and is energized by the motor (1) during the compression cycle and is not used in compressing the air.

Figure 3:
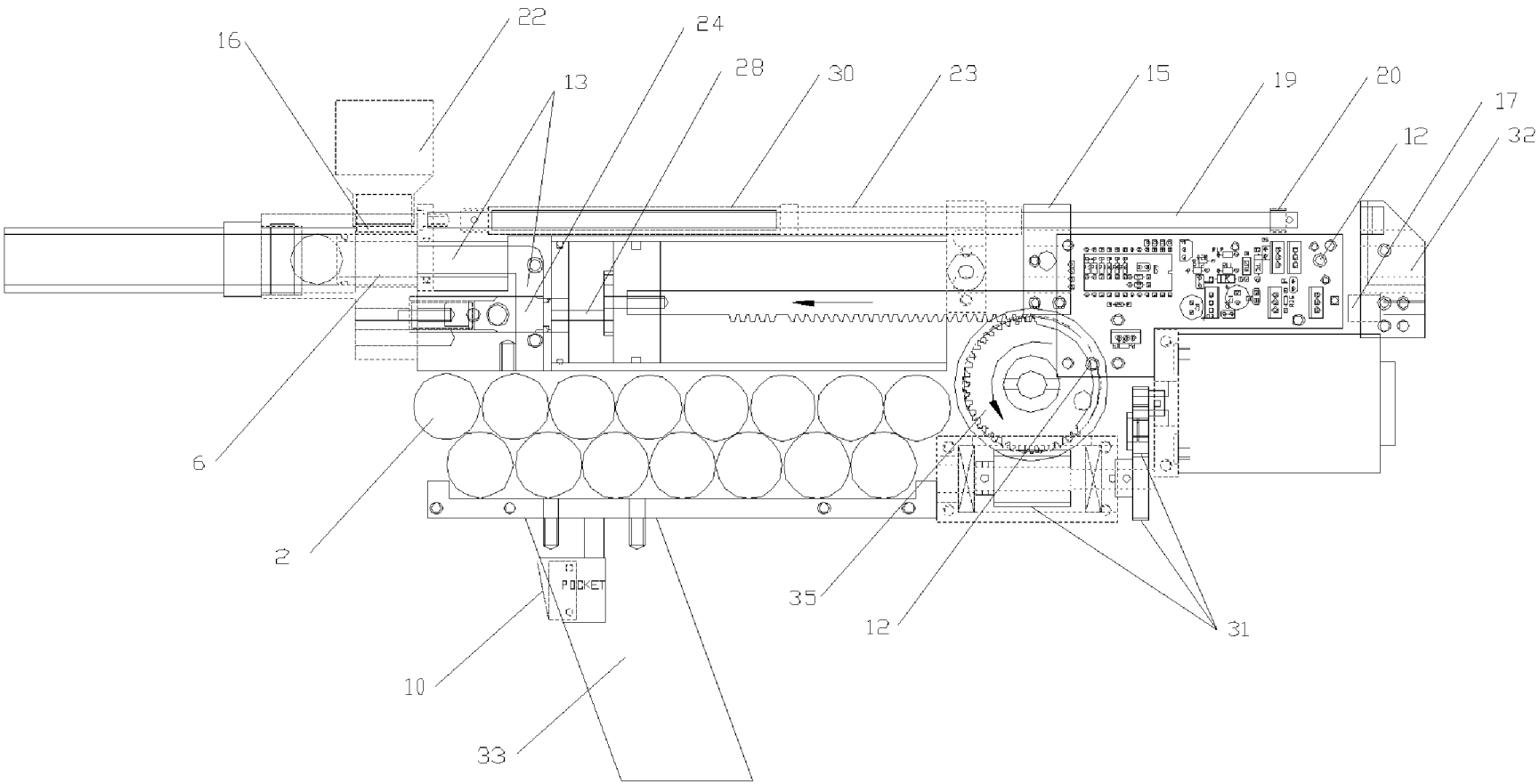
FIG. 3 is a side view showing the piston contacting the mechanical valve spool.

Referring to FIG. 1, the cycle is initiated by the user pressing a start switch (10) or trigger that causes power to be directed from the power source (2) to the motor (1) through the control circuit (3). The control circuit (3) may be any apparatus for connecting and disconnecting power to the motor (1) to allow a linear air compressor to pressurize air against a valve, cause the valve to open allowing air to flow thru the compressed air passageway (13) as shown in FIG. 3 past the projectile inlet port (16) and forcefully ejecting the projectile out of the barrel. The rack (4) and piston (5) assembly (referred to as a linear air compressor) is returned to substantially the same start position by the piston return spring (32). Directing power to the motor (1) causes it to turn, transferring energy through the rotating elements of the system and into the rack pinion (35) as shown in FIG. 3. The rack pinion (35) rotates as shown in FIG. 3 where the rack pinion (35) meshes with the teeth in the rack (4). The rack (4) preferably has one or more teeth substantially removed behind the initial engagement tooth.

An advantage found was that by removing or cutting down one or more teeth past the initial engagement tooth, the alignment tolerance for engagement between the rack (4) and the rack pinion (35) at the start of the cycle is substantially improved. This significantly improves the wear characteristics of the mechanism since it increases the engagement tolerance of the rack pinion to the rack by more then 50% making it far less likely that the initial teeth mesh in an interfering fashion. The motor (1) continues to rotate transferring energy through the drive train (31) which is a series of gears forming a reduction apparatus. This in turn rotates the rack pinion (35). This moves the rack (4) and the piston (5) towards the compression valve (7) compressing the air in the forward air chamber (21). The air in the forward air chamber is compressed in such a way that the compression exponent is greater then 1. Compression exponents greater then 1 yield higher air pressures then would be expected for a given compression ratio thus making a more efficient design. The simplified formula for compression can be written as: $PV^n=K$. Where P is pressure, V is volume, n is the compression exponent and K is a constant. For air in isothermal compression the exponent is 1, for adiabatic compression it is about 1.4. In an efficient design, the compression cycle is sufficiently short as to yield a compression exponent of approximately at least 1.10. The air in the forward air chamber (21) is held between the piston (5) and the cylinder end cap (29) until the compression valve (7) opens. By trapping the air in the forward air chamber (21), the compressed air in the forward air chamber (21) can be released while the rack pinion still has good engagement to the rack (4) as clearly shown in FIGS. 3 and 4. This gives the advantage of allowing a higher contact ratio between the invention's rack pinion (35) and rack (4) than has heretofore been seen on an intermittent gear and rack mechanism. Previously, the contact ratio has gone to zero at the point at which the rack (4) releases from the rack pinion (35) leading to severe gear tip wear and short life in those commercial mechanisms. Contact ratio as commonly defined in gear technology is the ratio of the length of path of contact of a gear mesh to the base pitch. This higher contact ratio provides the advantage of substantially reducing the wear on the rack (4) and rack pinion (35) over other designs and allows the launching of larger more energetic projectiles such as those used in paintball. Once the rack and rack pinion are initially fully engaged, the rack (4) and rack pinion (35) maintain a contact ratio of approximately greater then 0.1 until the compression valve (7) is released.

Further attached to the rack (4) is a bolt link (15) which can slide along the bolt rod (19). As the rack (4) moves forward it contacts the lost motion coupling (23) which slides along the bolt rod (19). As the rack (4) and piston (5) continue forward, the bolt link (15) pushes on the lost motion coupling (23) to cause it to engage the bolt limit spring (30). The lost motion coupling (23) allows the motion of the bolt (6) to be limited to a fraction of the movement of the piston (5) thus increasing the efficiency of the design. The movement of the bolt is limited to less then approximately 80% of the movement of the piston.

Figure 4:
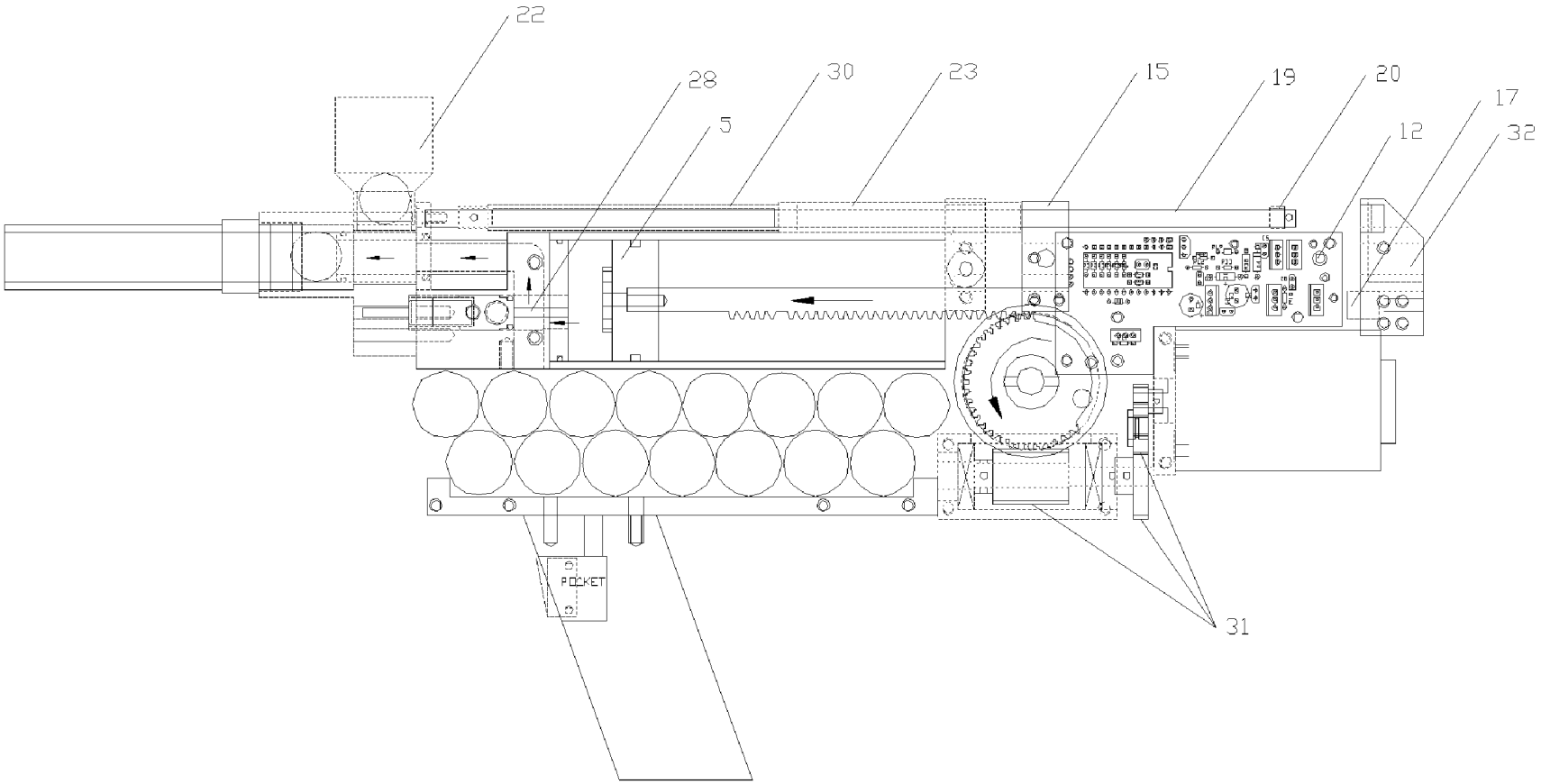
FIG. 4 is a side view showing the valve spool in the fully open position.

The bolt limit spring (30) compresses against the bolt rod (19) moving the bolt (6) forward chambering the projectile (9) and further shutting off the projectile inlet port (16) as shown in FIG. 4. The shutoff of the projectile inlet port (16) by the movement of the bolt (6) functions to direct the air out the barrel rather then allowing a portion to flow thru the projectile inlet port. This action is sometimes referred to as a valve but is substantially different from the compression valve (7) which performs another function in the present invention. Additionally, the bolt limit spring (30) limits the maximum bolt closure force which reduces chance of injury at the pinch point between the bolt (6) and the projectile inlet port. (16) Once the projectile has been chambered and the projectile inlet port (16) has been shut off, the compression valve (7) is opened.

Figure 5:
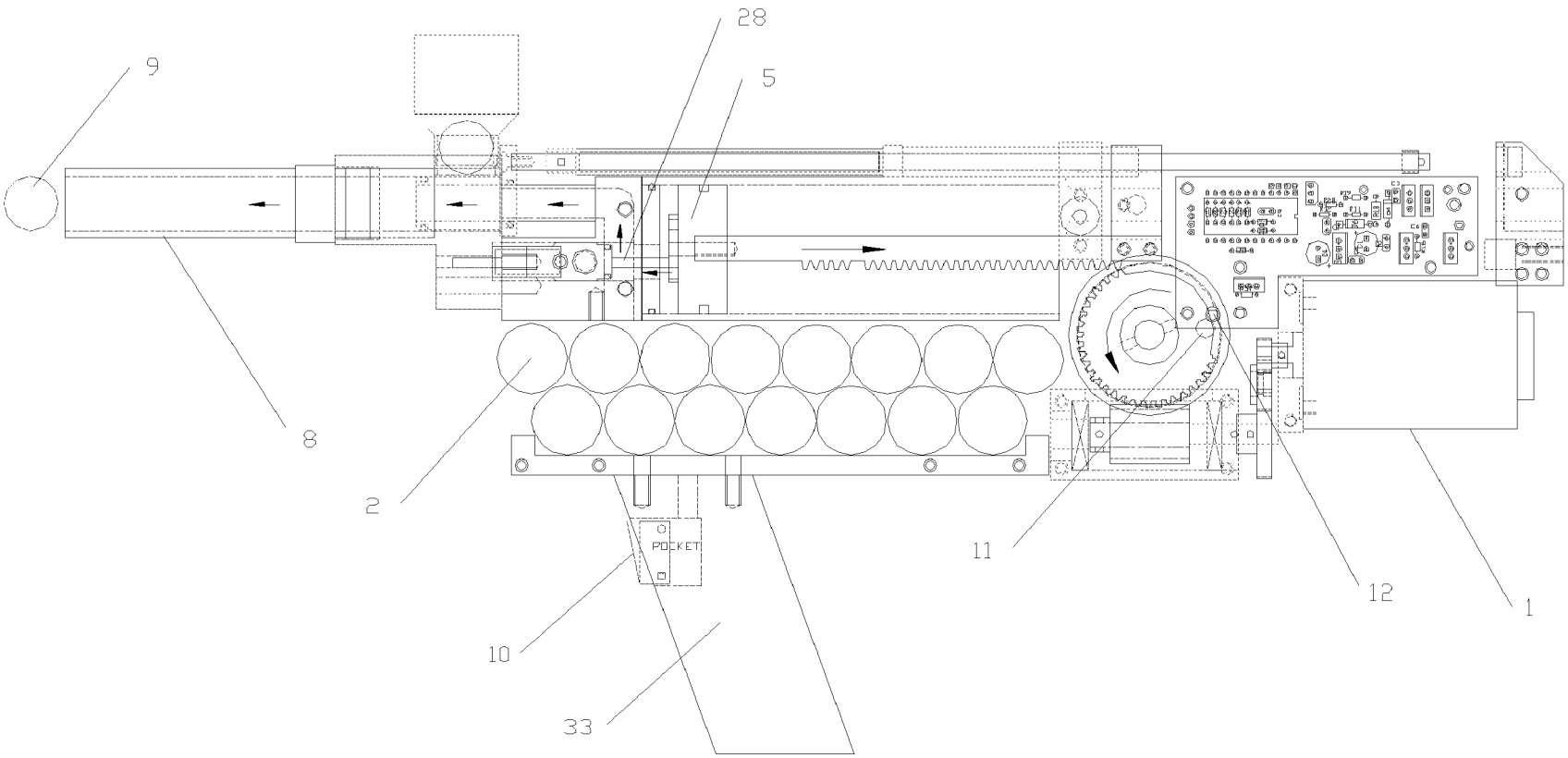
FIG. 5 is a side view of the rack at the disengagement point to the rack pinion.
Figure 6:
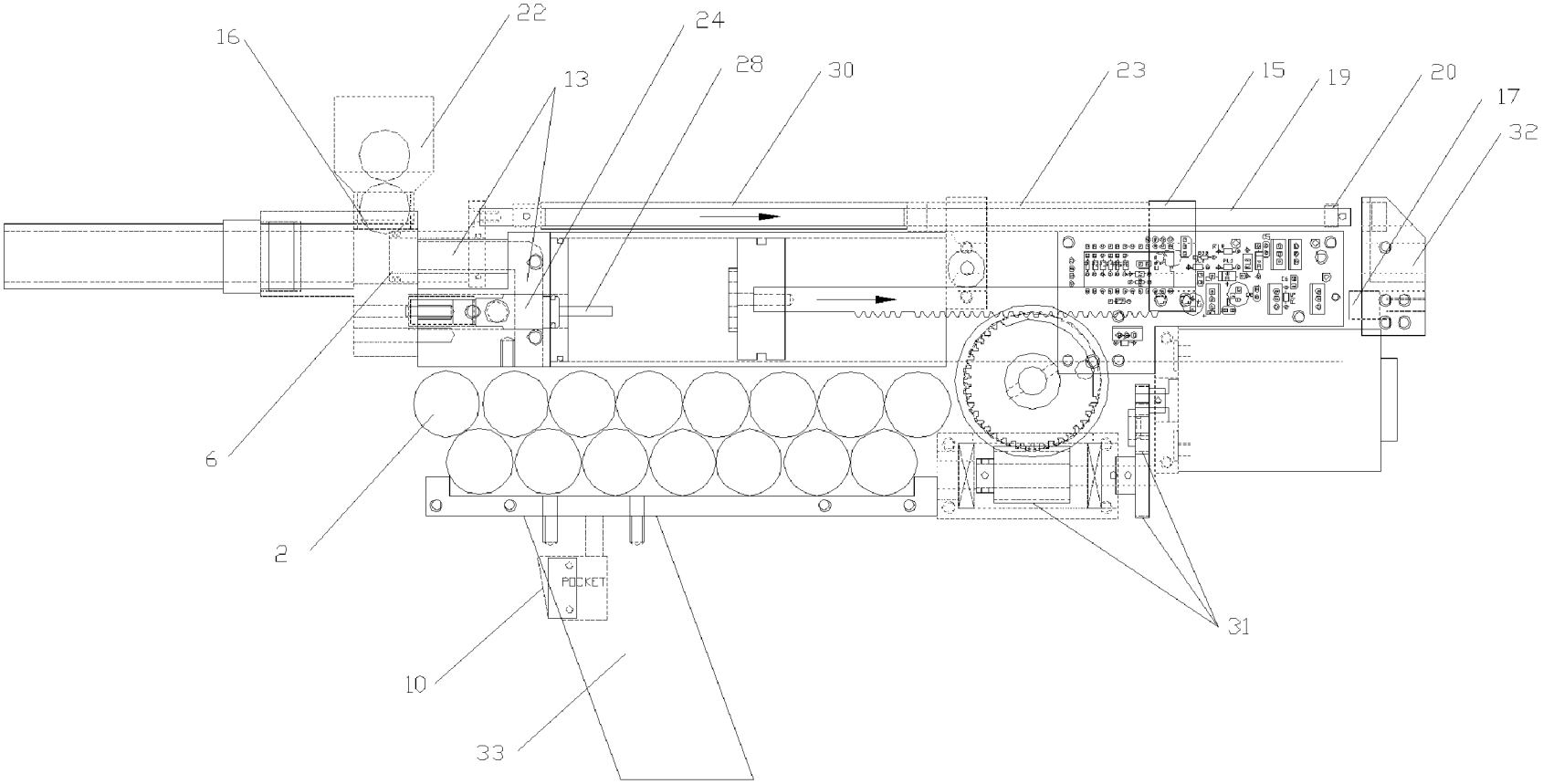
FIG. 6 is a side view showing the rack and piston during the return stroke.
Figure 7:
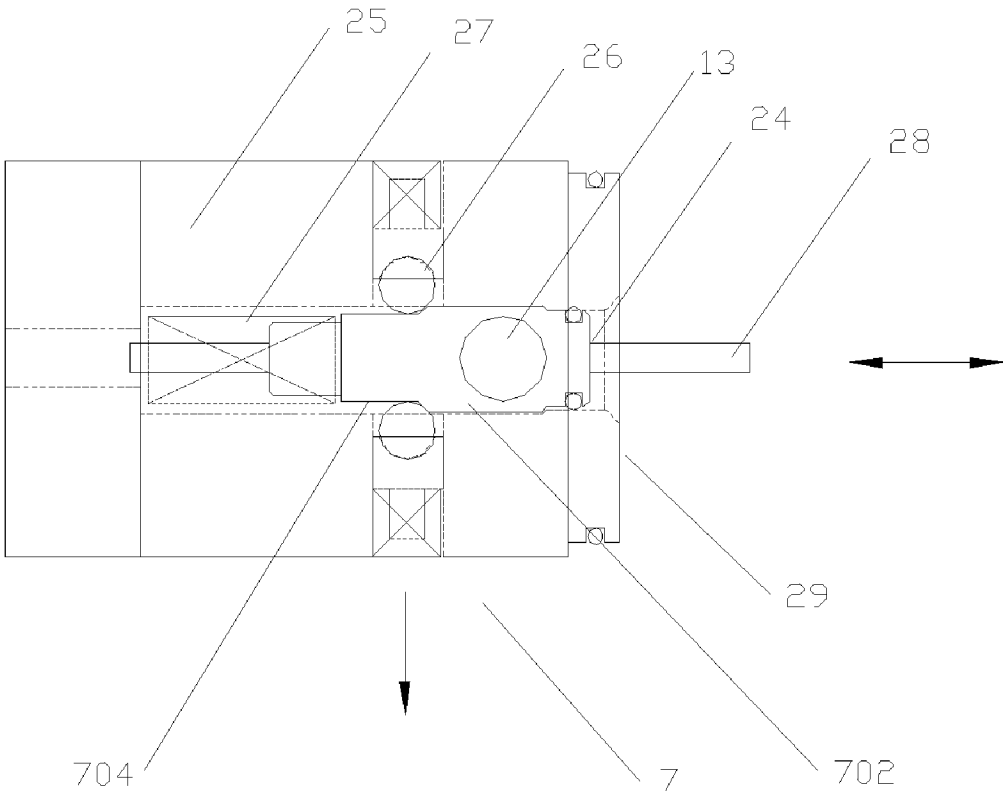
FIG. 7 is a top view of the valve in the closed position.
Figure 8:
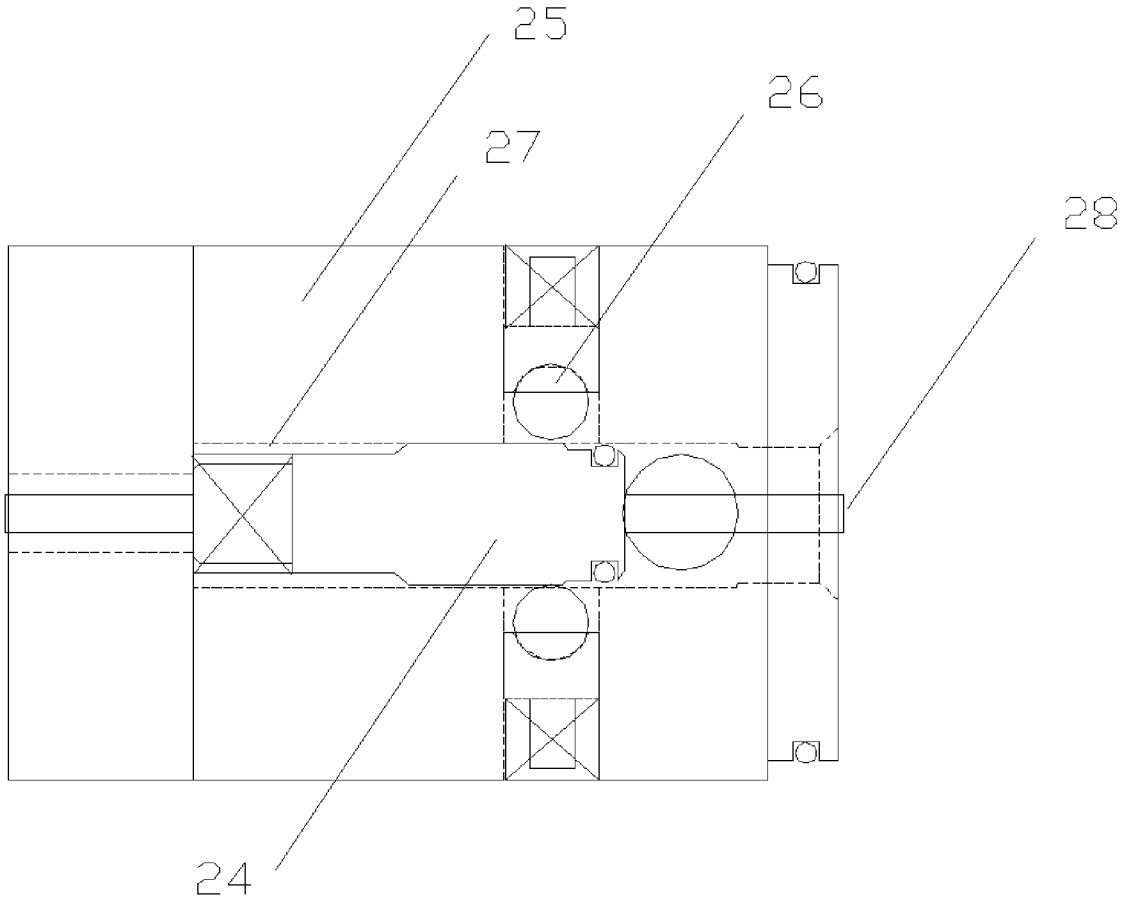
FIG. 8 is a top view of the valve in the open position.
Figure 9:
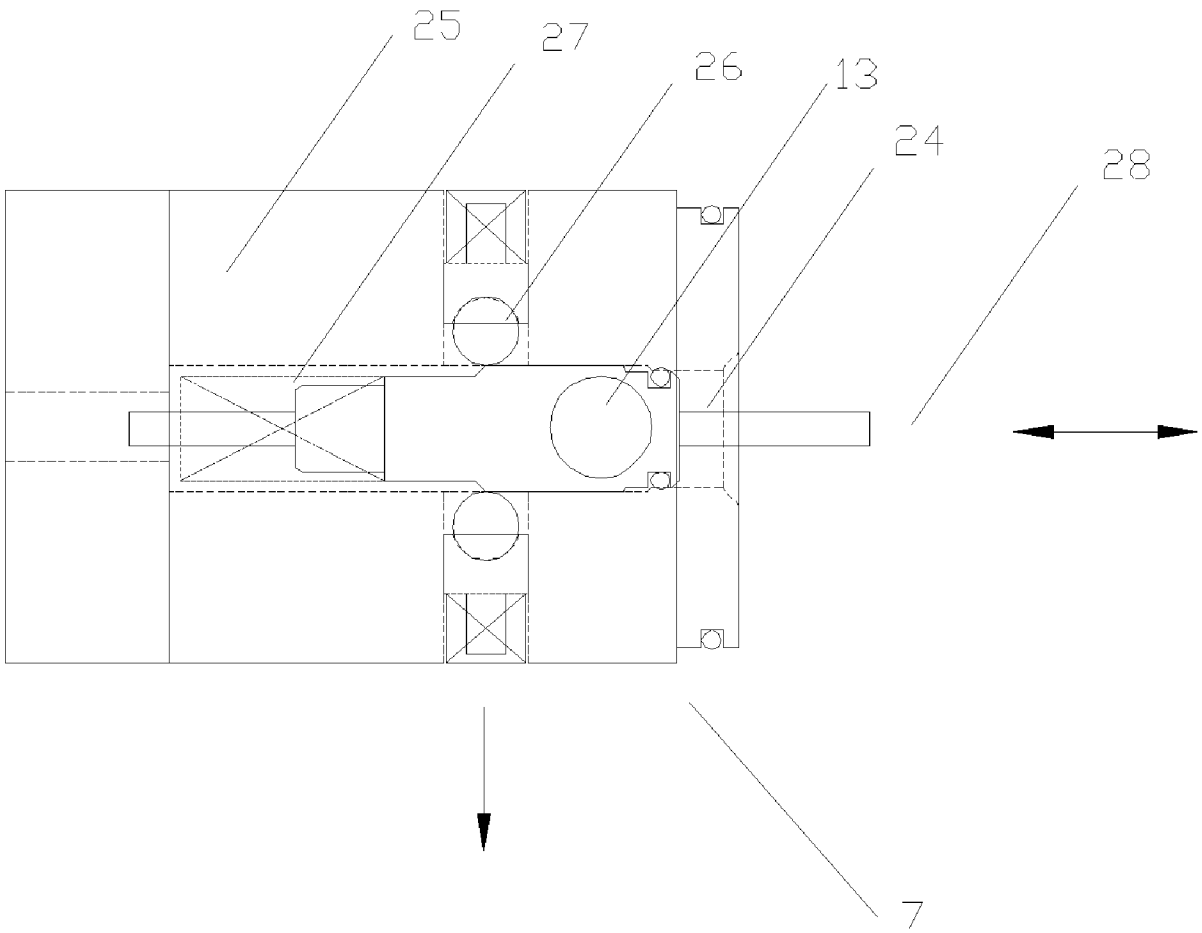
FIG. 9 is a top view of the valve at the tipping point.
Figure 10:
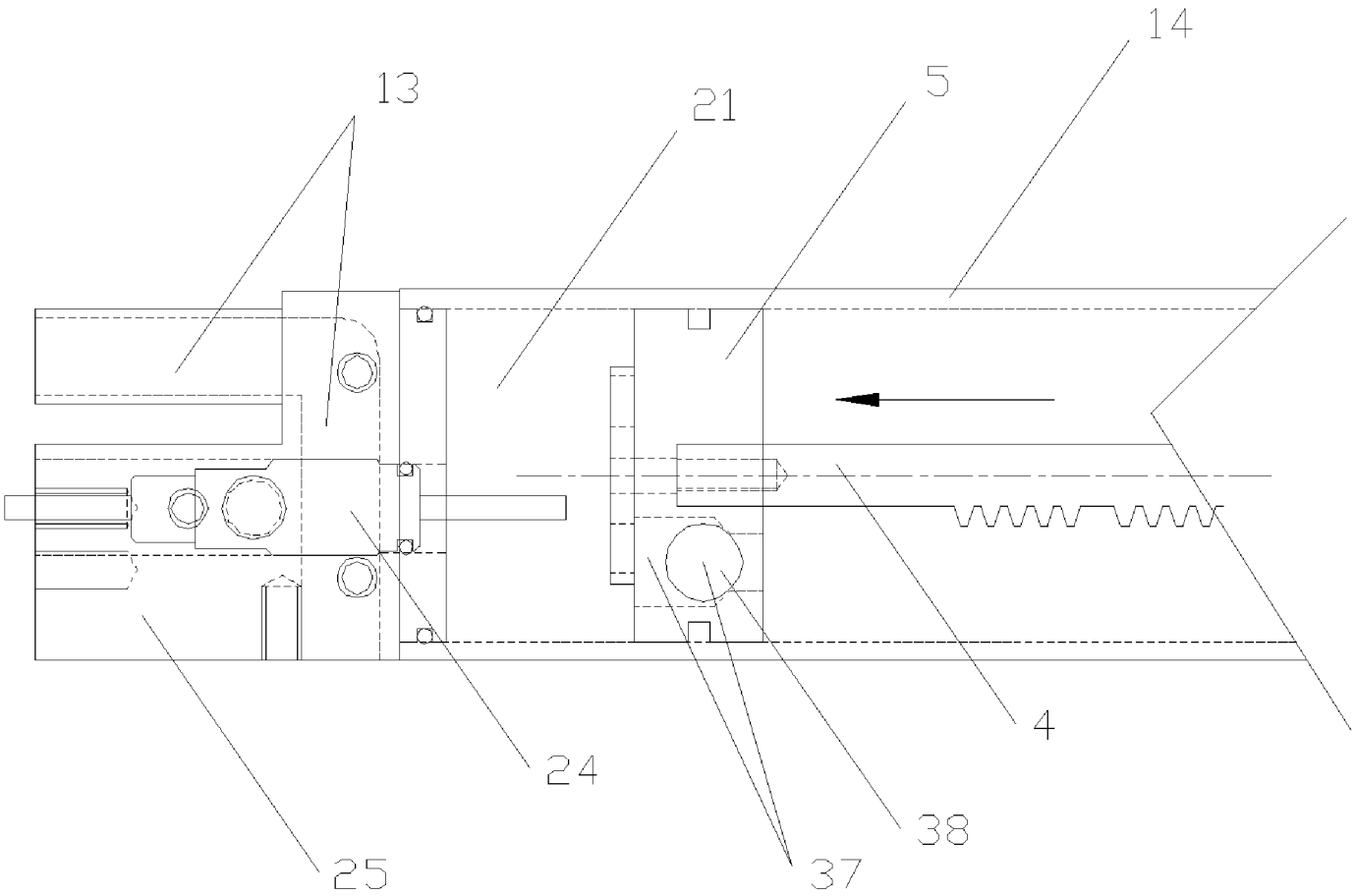
FIG. 10 is a side view of the piston with check valve closed.
Figure 11:
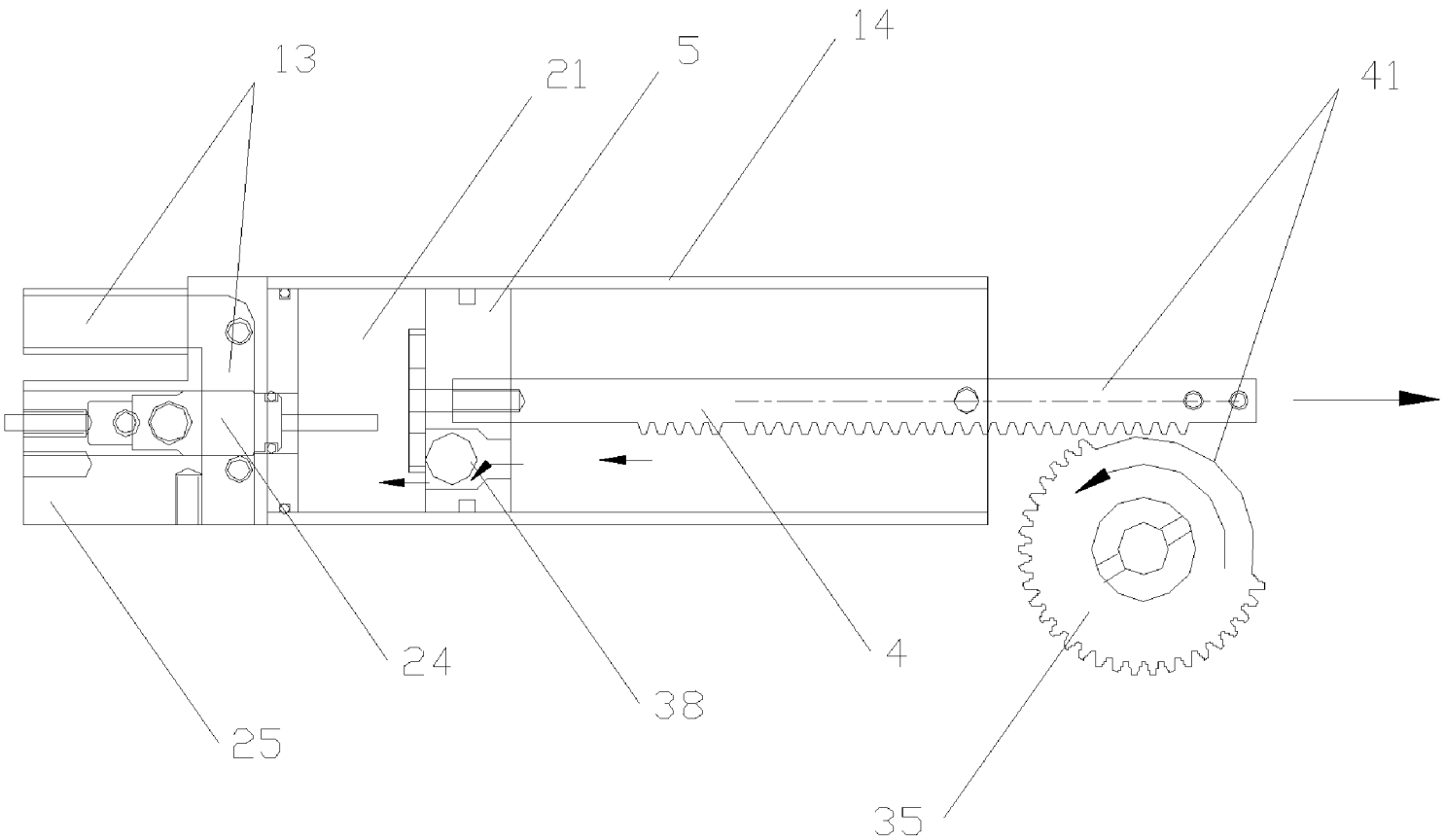
FIG. 11 is a side view of the piston with ball check valve opened.
Figure 12:
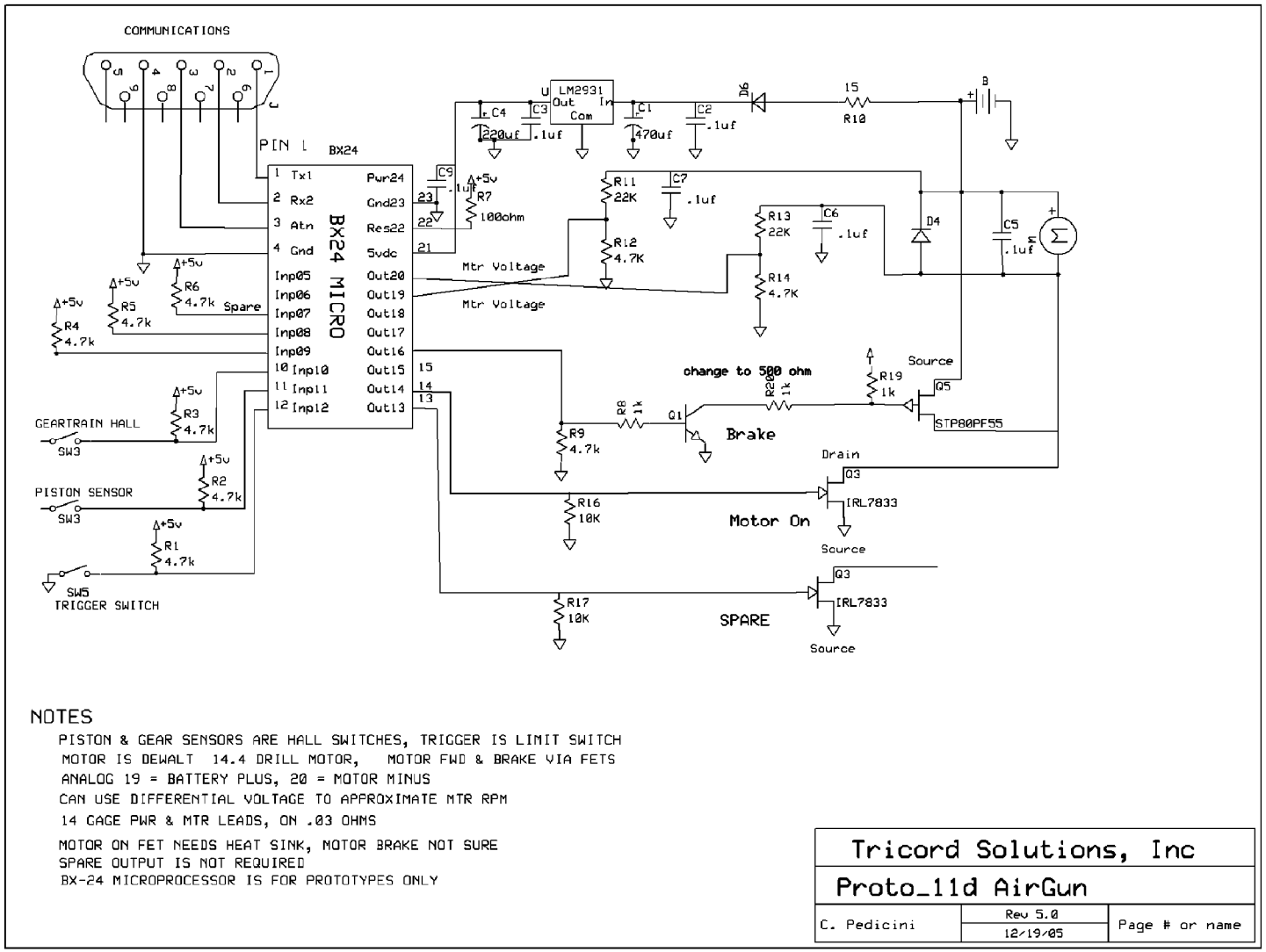
FIG. 12 is a control circuit schematic.
Figure 13:
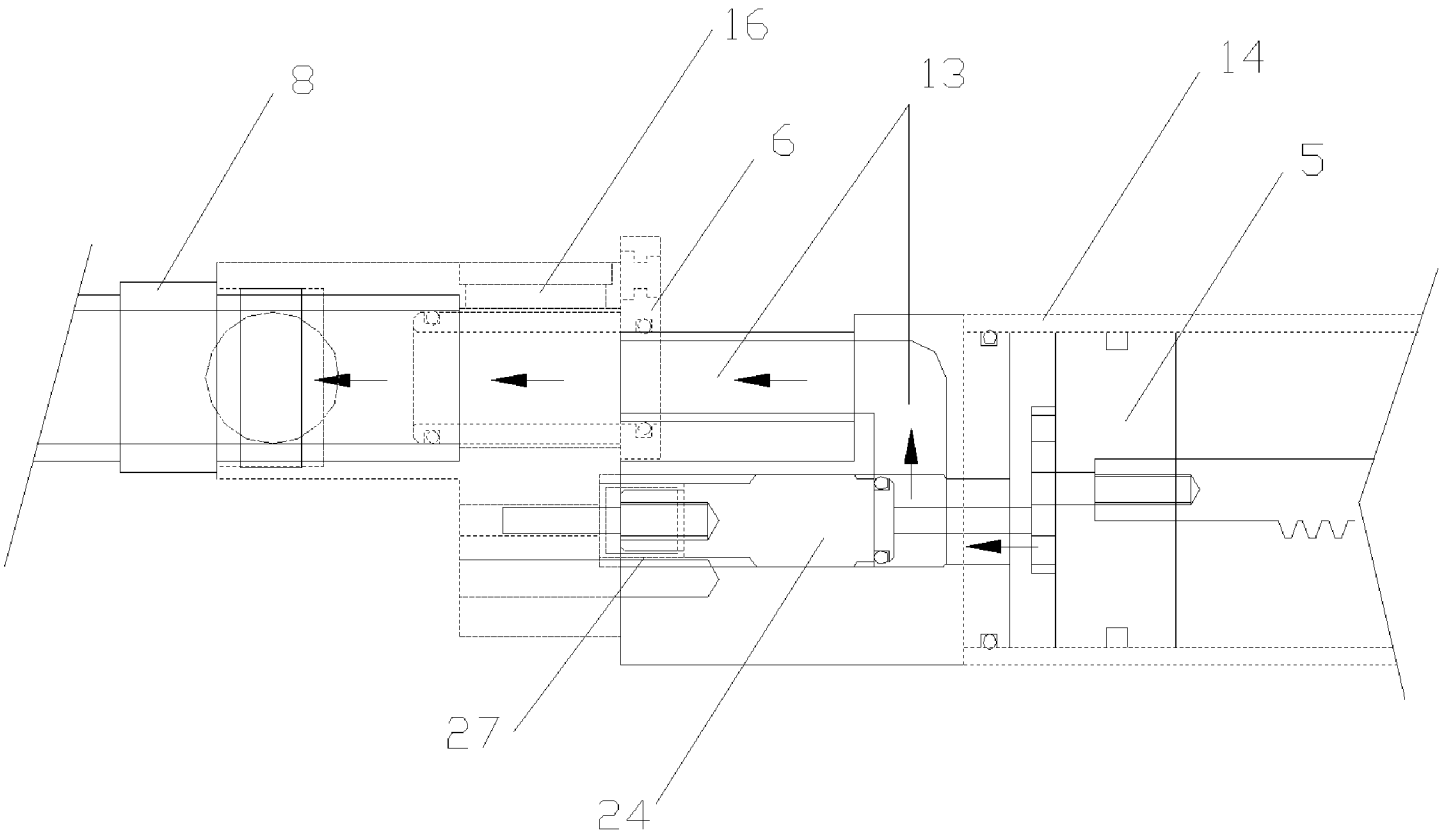
FIG. 13 shows the valve operation in relation to the compression piston.

Two parameters play importantly in the design of the valve (7): the pressure drop through the compression valve (7), and the valve opening time. It was originally thought that standard valve designs used in air guns would be suitable for the present design, but upon testing, it was found that they were structurally inefficient and not suitable for an electric air gun. The compression valve (7) in the preferred embodiment is referred to as a mechanical snap acting valve in which the valve has an opening speed of less then 20 milliseconds from initial cracking to greater then substantially 70% of full flow. One way to meet this requirement is that the actuation or opening force is approximately a minimum of 1.5 times the maintaining force for the valve. The preferred embodiment of the compression valve (7) is shown in FIGS. 7, 8, 9, 10 and 13. In FIG. 7, the compression valve sealing member alternately referred to henceforth as the valve spool (24) is shown seating up against the valve body (25). The valve spool (24) articulates in a direction parallel to the piston and rack. The valve spool (24) is held in position by two valve retainers (26) which are positioned in an opposed relationship, and a valve return spring (27). The composition of the valve retainers (26) in this embodiment are two cups and two balls but they could be any apparatus which retains the valve spool (24) or sealing member in the initial sealed state until a threshold pressure or force is applied. The valve spool (24) includes a main body (702) and a reduced diameter body (704). The valve spool (24) is such that the valve retainers (26) act on a detent or an inclined portion between the main body (702) and the reduced diameter body (704) of the valve spool (24) in such a fashion that once the valve retainer (26) moves relative to the surface of the valve spool (24) past the incline ramp on the valve spool (24) and is adjacent to the main body (702) and moves away from the reduced diameter body (704) (FIG. 9) the maintaining force of the valve spool (24) is reduced by more then substantially 50%. The restoration force of the valve spool (24) is provided by the valve return spring (27). These design features causes the valve spool (24) to have a tipping point which when exceeded causes the valve spool (24) to quickly snap open thereby communicating the compressed gas in the air chamber thru the compressed air passageway (13) and to the projectile causing the projectile (9) to exit the barrel (8). The result of such a design is that a standard 68 caliber paintball can be launched at approximately 300 fps when the air in the forward air chamber (21) is compressed to approximately 160 psi with a volume of approximately 1.2 $in^3$. Using other valves which do not open as quickly or as fully caused a drop in velocity of over 70 fps. Since energy is the square term of velocity, those valves required more then 2× the input energy for the same energy output in the projectile. The present design for illustration uses a valve spool (24) weighing approximately 1 oz, a valve return spring (27) compressed to approximately 3 lbs and valve retainers (26) resulting in an opening force of approximately 24 lbs. The face diameter of the valve spool (24) is approximately 0.437 in. The internal pressure in the forward air chamber reaches approximately 160 psi resulting in a force on the face diameter of the valve of 24 lbs. This moves the valve spool (24) past the tipping point (a displacement of approximately 0.06 inches) at which the maintaining force drops to 3 lbs. The tipping point is clearly shown in FIG. 9 in which the oring on the valve spool (24) has not moved past the compressed air passageway (13) thus leaving the air under compression in the forward air chamber (21). The oring is an elastomenc element which functions as a sealing member to allow clearance between the valve spool and the valve body. The opening force on the valve spool (24) is approximately 21 lbs. The additional stroke of the valve spool (24) to the fully open position shown in FIG. 8 is 0.5 inches. This distance is traversed in less then approximately 5 milliseconds resulting in nearly instantaneous communication of the compressed air in the forward air chamber (21) thru the compressed air passageway (13) by the projectile inlet port (16) and forcing the projectile out the barrel. The above weights, distances and forces are merely for illustrative purposes and not meant to limit the scope of the invention. An advantage of the Cv characteristics and snap action feature of this valve is that the compression energy can be reduced significantly and by more then approximately 30% over standard valves used in bb or paintball guns. The term Cv refers to the flow coefficient of a valve and relates the pressure drop across a valve to the flow thru the valve. A high Cv valve gives a larger flow of thru a valve at a given pressure drop then a low Cv valve. An advantage of our valve design is the combination of high Cv with a very fast opening speed resulting in a very efficient conversion of air energy to projectile energy. A second feature of the valve spool (24) in the preferred embodiment is a valve stem (28). Opening of the valve spool (24) can occur when the pressure in the forward air chamber exceeds the maintaining pressure of the valve retainers (26) and valve return spring (27) or preferably when the piston (5) pushes the valve stem (28) moving the valve spool (24) past the tipping point. The contact of the piston (5) to the valve spool stem (28) can be seen in FIG. 3. The valve spool (24) is shown in the full open position in FIG. 5 at which point the air in the forward air chamber (21) is in communication with the projectile (9) and can propel it out the barrel (8). A further illustration of this is shown in FIG. 13. The valve stem (28) allows the piston (5) to hold the valve open even when the pressure in the forward air chamber drops. This further improves the efficiency of the valve since the valve is held open even as the pressure in the forward air chamber (21) drops below the pressure required to hold the valve spool (24) open under the action of the valve return spring (27). A further advantage of the invention is that the valve spool (24) can no longer stick in the closed position. If the valve spool (24) were to stick in the closed position during a cycle and the rack pinion (35) were to release the rack (4), the rack and piston assembly would be thrown violently towards the rear of the apparatus potentially causing damage. The piston (5) and rack (4) continue to move in the forward direction until the cutaway teeth on the rack pinion (35) are opposite the rack (4). The rack and pinion are now returned to the initial position via a mechanical storage element such as the piston return spring (32). The piston return spring (32) does not play a direct part in the compression of the air and is sized such that its total energy is less then approximately 25% of the energy required to propel the projectile. In this particular design, the total return energy in the spring is approximately 1.5 ft lbs. In the return process, makeup air should be allowed to rapidly enter the forward air chamber. Although any valve could be used for this purpose, it is preferred to use a mechanical check valve (37) contained within the piston (5) as shown in FIG. 11. On return of the piston (5) and rack (4), air pushes the check valve ball (38) away from the sealed position and flows thru the check valve (37) replenishing the forward air chamber (21). The piston return spring (32) is preferentially a constant force spring located external to the air cylinder. Constant force springs are particularly suited to this invention because of the characteristics of long stroke, light weight and constant force. The constant force in the fully retracted position provides more stability and better position control of the rack (4) in its initial starting position. Although constant force springs are advantageous, the piston return spring (32) could be any elastic element which is energized during the compression stroke of the piston. The excess energy from the return of the piston (5) and rack (4) are absorbed by the bumper (17). The bumper (17) only need absorbs the small amount of kinetic energy caused by the return of the rack (4) and piston (5) assembly and is preferably made from an elastomer. The valve spool (24) is now free to return to the closed position via the valve return spring (27). Solenoid valves can be used as alternatives to the mechanical valve. The release of the rack pinion (35) from the rack (4) is preferably detected using a sensor (12) which causes the control circuit (3) as shown in FIG. 12 to turn off the motor power and brake the system. The return of the rack (4) to its initial position is preferably detected using an additional sensor (12) and marks the completion of a cycle. An additional feature of this embodiment is to limit the number of teeth in the rack (4) behind the initial engagement point. This makes it impossible for the piston to bottom out against the cylinder end cap (29) in the compression and firing cycle. This embodiment therefore has an advantage by eliminating the double recoil limitation of existing designs.

Figure 14:
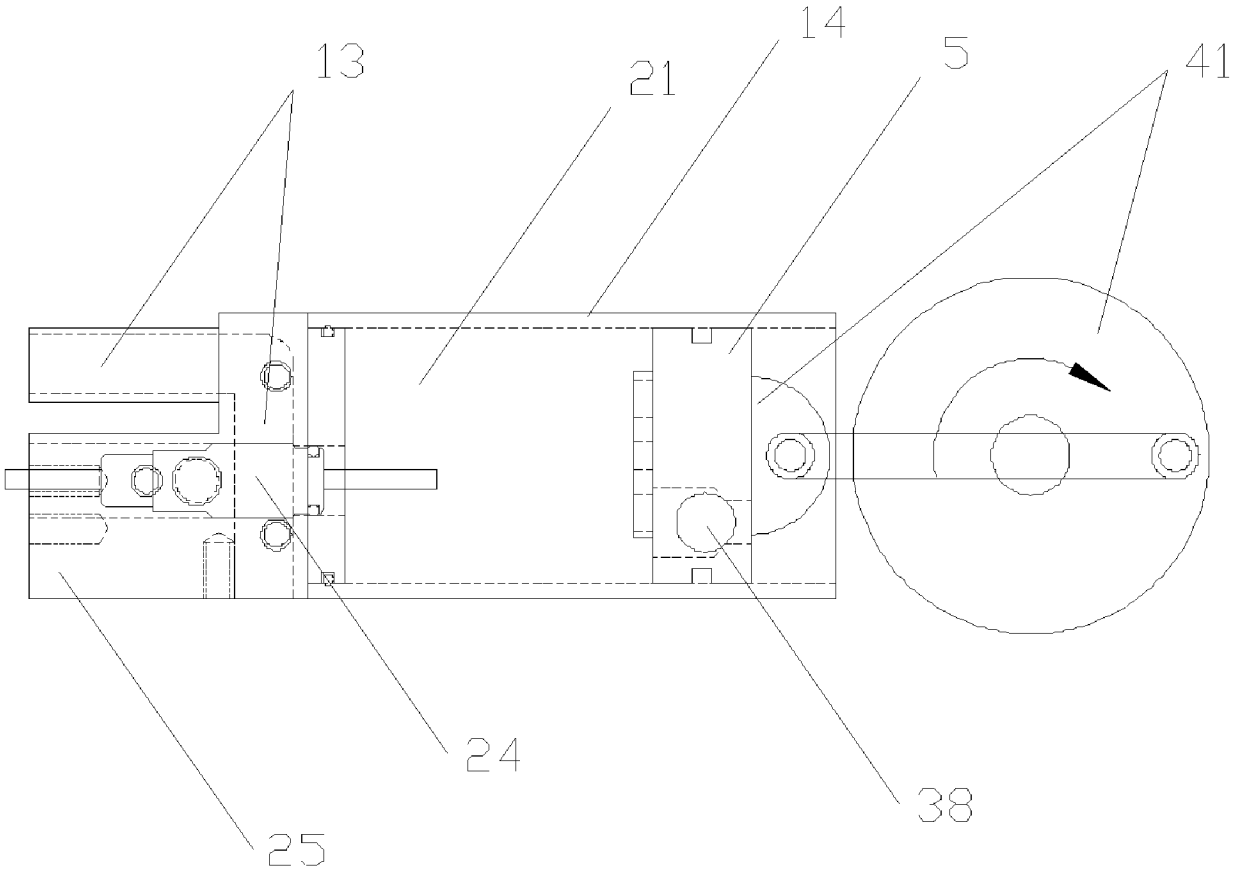
FIG. 14 shows a second embodiment employing a harmonic drive in the start position.
Figure 15:
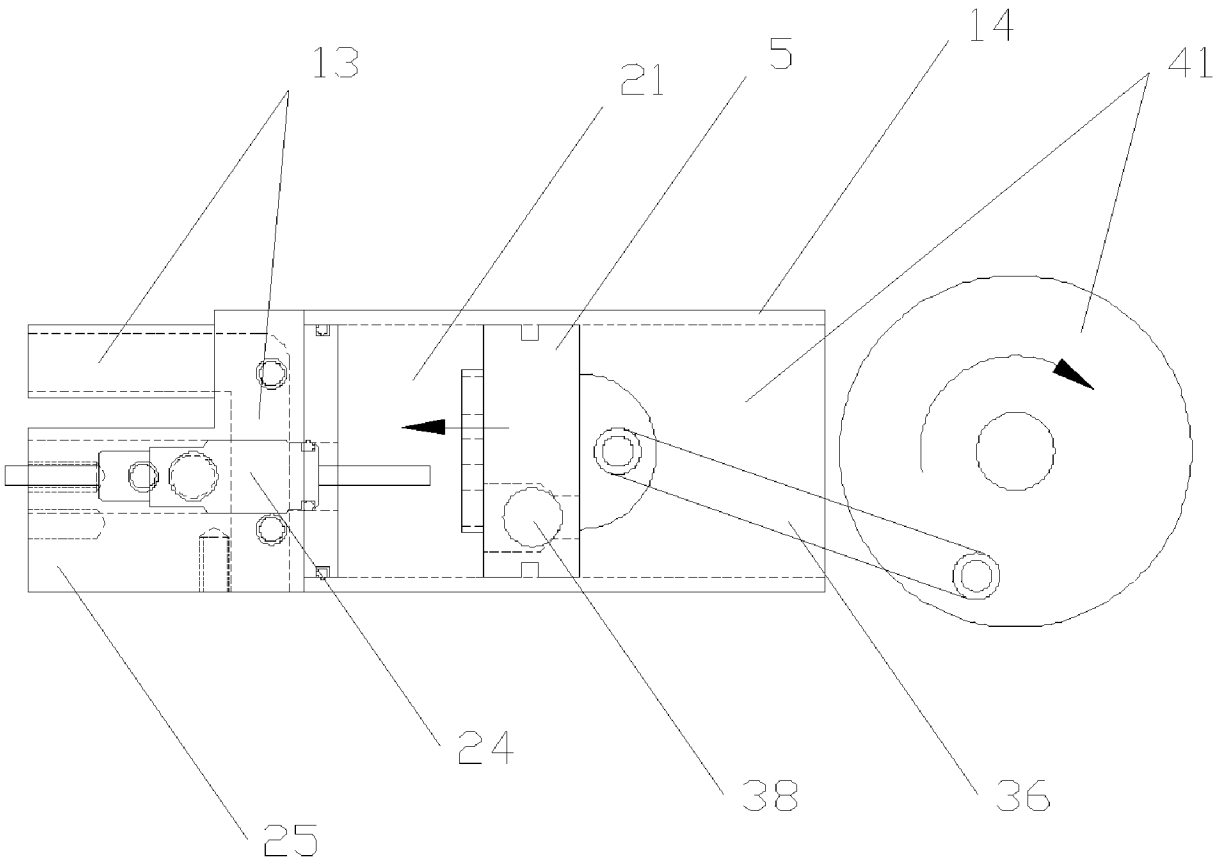
FIG. 15 shows the second embodiment employing a harmonic drive in the middle of the compression stroke.
Figure 16:
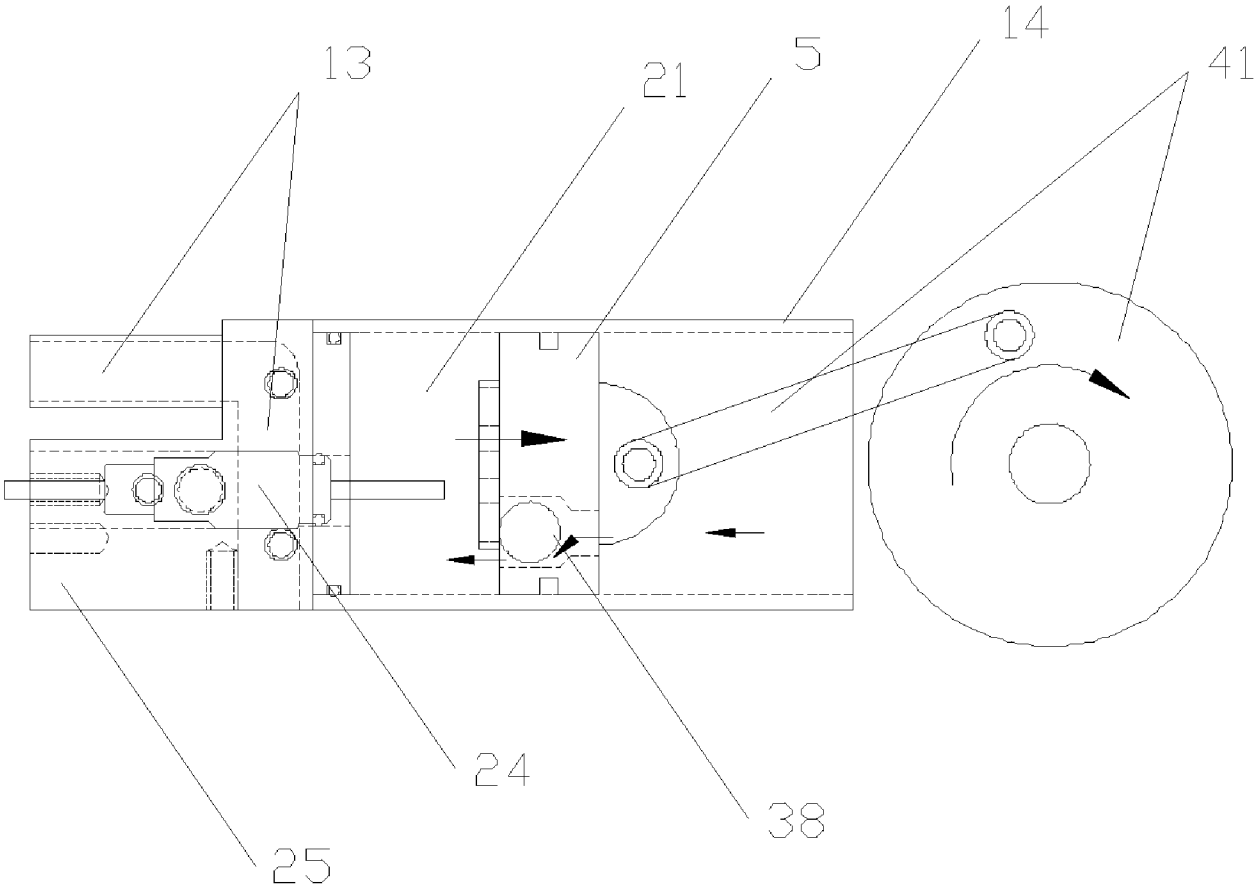
FIG. 16 shows the second embodiment employing a harmonic drive in the return stroke.

The interrupted rack pinion (35) and rack (4) together form a linear motion converter which converts the rotational motion of the motor to the linear motion of the rack. Alternative embodiments to the rack (4) and rack pinion (35) include a slider crank, eccentric or cam drive which power the piston (5) in a lineal direction to compress air in the forward air chamber (21) against the cylinder end cap (29) and compression valve (7). These alternative embodiments have useful advantages including the elimination of engagement and disengagement as well as elimination of the piston return spring (32). This embodiment would provide for a positive return of the piston (7) to an initial position thus potentially simplifying the apparatus and improving its reliability. FIG. 14 shows one possible implementation of such an embodiment. In this figure, the piston (5) is shown at a starting position of approximately +/−60 degrees around bottom dead center. The linear motion converter (41) in this case is a slider crank and rotates in cooperation with the motor and gear reduction apparatus to push the piston (5) and compressing the air in the forward air chamber (21) against compression valve (7) as shown in FIG. 15. The operation of the valve is similar as which has been heretofore described and releases the compressed air to launch the projectile. The return of the piston (5) and replenishment of air in forward air chamber (21) is shown in FIG. 16. The control circuit and appropriately placed sensors could easily allow for a consistent start and stop cycle. Although the reduction apparatus in these embodiments is shown as a spur and worm gear drive, other reduction apparatus such as pulleys, belts, chains and planetary drives, could be used without departing from the spirit of the invention.

Circuit Operation:

A schematic of the preferred control circuit (3) is shown in FIG. 12. In the preferred embodiment, the control circuit (3) includes a microprocessor, high power switching elements and three control circuit inputs. An interface can display faults. The control circuit (3) can input signals from timers and/or sensors. Looking additionally to FIG. 1, this embodiment uses a start switch (10) and either a sensor or another suitable apparatus to inhibit the start switch to ensure that the compression piston (5) is in the initial position. This embodiment employs a hall sensor (12) and a magnet which moves cooperatively with the rack (4) and piston (5) assembly. Additionally, a method and apparatus of determining motor speed using FETs or relays to control the power to the motor (1) are advantageous. Motor speed sensing is useful in determining and responding to a fault condition. Speed sensing means could include voltage or current sensing on the motor or a rotational sensor located within the drive train (31). In order to maintain responsiveness of an electric air gun, it is desirable that the overall resistance from the power source (2) to the motor (1) be kept very low. A second sensor (12) is used to determine the decoupling of the rack (4) from the rack pinion (35). In this embodiment, a magnet is attached to the rack pinion (35) and a hall sensor is used to determine when the rack pinion (35) disengages from the rack. Once the rack pinion (35) has disconnected from the rack (4), power can be removed from the motor and the motor can be braked dynamically. This brings it to a quick stop and prevents over rotation of the rack pinion (35) where it could possibly jamb into the returning rack (4) before it has fully returned to its initial position.

An additional advantage of the present embodiment over prior designs is afforded by the use of the sensors (12). Using these sensors, it is possible to maximize the firing rate of the device by monitoring the start switch (10) after a cycle is initiated. One such technique is to monitor and store an additional actuation of the start switch (10) while the apparatus is in operation. The stored actuation is used in cooperation with a timer which begins a countdown when the additional start switch (10) actuation is recorded. The timer is set to correspond to a delay of less then 200 milliseconds and preferably 100 milliseconds. The stored actuation can automatically initiate a followup cycle if the sensor (12) detects that the rack (4) is back in the initial position before the timer setpoint is exceeded. This permits a more seamless operation of the apparatus and increases the firing rate since the initiation of a cycle does not have to be timed to the completion of the prior cycle. We call this feature shot storage.

Although the aforementioned elements are used in the preferred design, it is understood by those familiar with the art that considerable simplification is possible without departing from the spirit of the invention. It is further understood by those skilled in the art that the sensors can be used in conjunction with other circuit elements to allow location at different places and that sensors can be of many forms including but not limited to limit switches, hall effect sensors, photosensors, reed switches and current or voltage sensors without departing from the spirit of the invention.

Further preferred circuit embodiments include: low battery indicators, pulse control of motor power, communication ports, status or error displays, lock out on fault conditions, password or keyswitch requirements for operation. Additionally, the circuit could allow for various firing modes such as burst mode for example.

Thus, although there have been described particular embodiments of the present invention of a new and useful PORTABLE ELECTRIC-DRIVEN COMPRESSED AIR PROJECTILE LAUNCHER, it is not intended that such references be construed as limitations upon the scope of this invention except as set forth in the following claims.

We claim:

1. An electrically-driven compressed air gun used for firing a projectile, said gun comprising:

a power source to power a motor;

a sensor to obtain information of said motor;

a control circuit for controlling the motor using information from the sensor;

a rack pinion coupled to said motor;

a rack which engages said rack pinion;

a piston coupled to said rack;

a cylinder responsive to the piston in which the piston reciprocates to compress air;

a mechanical storage element coupled to said rack active in a direction opposite the compression of the air;

a projectile chambered by a bolt;

a projectile inlet port;

a valve formed by movement of said bolt against said projectile inlet port a barrel to receive the projectile;

an air passageway between said cylinder and said projectile a compression valve interdisposed between said cylinder and said air passageway wherein said compression valve allows air from the cylinder to exit thru the compression valve to the air passageway pushing said projectile out of said barrel.

2. An electrically-driven compressed air gun used for firing a projectile as in claim 1, wherein the mechanical energy storage element includes one of the group consisting of: a mechanical spring, a constant force spring, an air spring, an elastomeric element or a vacuum.

3. An electrically-driven compressed air gun used for firing a projectile as in claim 1, wherein the rack has at least one tooth immediately adjacent the initial engagement tooth that is at least partially removed.

4. An electrically-driven compressed air gun used for firing a projectile as in claim 1 wherein the projectile is one from the group consisting of a paintball, an airsoft ball, a "bb", a pellet or a foam ball.

5. An electrically-driven compressed air gun used for firing a projectile as in claim 1, wherein the movement of the bolt is limited to less then approximately 80% of the piston movement.

6. An electrically-driven compressed air gun used for firing a projectile as in claim 1, wherein the motor is braked.

7. An electrically-driven compressed air gun used for firing a projectile as in claim 1, wherein sufficient teeth are removed from the rack such that said piston can not impact the cylinder end cap.

8. An electrically-driven compressed air gun used for firing a projectile as in claim 1, wherein the coupling to the bolt includes a spring and a sliding element.

9. An electrically-driven compressed air gun used for firing a projectile as in claim 1, wherein said gun includes shot storage.

10. An electrically-driven compressed air gun used for firing a projectile as in claim 1, wherein said air gun includes a check valve.

11. An electrically-driven compressed air gun used for firing a projectile as in claim 10, wherein the piston includes the check valve.

12. An electrically-driven compressed air gun used for firing a projectile as in claim 1 wherein the speed of the motor is actively controlled.

13. An electrically-driven compressed air gun used for firing a projectile as in claim 1 wherein a compression exponent of at least 1.1 is achieved.

14. An electrically-driven compressed air gun used for firing a projectile, said gun comprising:

a power source to power a motor;

a sensor to obtain information corresponding to said motor;

a control circuit for controlling the motor using said information from the sensor;

a piston to compress air and driven by said motor;

a cylinder in which the piston reciprocates;

a compression valve;

the piston being driven linearly to compress air in the cylinder against said compression valve;

a bolt for chambering said projectile;

a projectile inlet port;

a second valve formed by movement of the bolt against the projectile inlet port;

a barrel to receive the projectile;

an air passageway interdispersed between said cylinder and said second valve;

an apparatus to open said compression valve to allow air compressed by said piston to flow thru said compression valve and air passageway to said projectile.

15. An electrically-driven compressed air gun used for firing a projectile, said gun as in claim 14, wherein the piston is coupled to one of a group consisting of: a slider crank, an eccentric or a cam.

16. An electrically-driven compressed air gun used for firing a projectile as in claim 14, wherein said air gun includes a mechanical storage element to resist the forward compressive movement of the piston.

17. An electrically-driven compressed air gun used for firing a projectile as in claim 14, wherein the projectile is selected from a group consisting of: a paintball, an airsoft ball, a "bb", a pellet or a foam ball.

18. An electrically-driven compressed air gun used for firing a projectile as in claim 14, wherein the movement of the bolt is limited to less then approximately 80% of the movement of the piston.

19. An electrically-driven compressed air gun used for firing a projectile as in claim 14, wherein the motor is braked.

20. An electrically-driven compressed air gun used for firing a projectile as in claim 14, wherein a coupling to the bolt includes at least a spring and a sliding element.

21. An electrically-driven compressed air gun used for firing a projectile as in claim 14, wherein said air gun includes shot storage.

22. An electrically-driven compressed air gun used for firing a projectile as in claim 14, wherein said air gun includes a check valve.

23. An electrically-driven compressed air gun used for firing a projectile as in claim 14 wherein the speed of the motor is actively controlled.

24. An electrically-driven compressed air gun used for firing a projectile as in claim 14 wherein a compression exponent of at least 1.1 is achieved.

25. An electrically-driven compressed air gun used for firing a projectile, said air gun comprising:

a power source to power a motor;

a sensor to obtain information from said motor;

a control circuit for controlling the motor using information from the sensor;

a reduction apparatus;

a rack pinion coupled to said reduction apparatus;

a rack which engages said rack pinion;

a piston coupled to said rack;

a cylinder for the piston to reciprocate to compress air;

a barrel to receive the projectile;

an air passageway between said cylinder and said projectile a compression valve interdisposed between said cylinder and said air passageway;

wherein said air compression valve releases air from said cylinder while said rack is still engaged with said rack pinion.

26. The apparatus according to claim 25, wherein the rack and rack pinion maintain a contact ratio of approximately greater then 0.1 until the compression valve is released.

27. An electrically-driven compressed air gun used for firing a projectile as in claim 25 wherein the motor is braked.

28. An electrically-driven compressed air gun used for firing a projectile as in claim 25 wherein the speed of the motor is actively controlled.

29. An electrically-driven compressed air gun used for firing a projectile as in claim 25, wherein said gun includes shot storage.

30. An electrically-driven compressed air gun used for firing a projectile as in claim 25 wherein a compression exponent of at least 1.1 is achieved.

* * * * *